US005975396A

United States Patent [19]

Manabe

[11] Patent Number: 5,975,396

[45] Date of Patent: Nov. 2, 1999

[54] ELECTRIC STAPLER

[75] Inventor: Katsunori Manabe, Tokyo, Japan

[73] Assignee: Max Co., Ltd., Tokyo, Japan

[21] Appl. No.: 08/953,214

[22] Filed: Oct. 17, 1997

[30] Foreign Application Priority Data

Nov. 13, 1996 [JP] Japan ..... 8-301598
Aug. 29, 1997 [JP] Japan ..... 9-233604

[51] Int. Cl.[6] ..... B27F 7/36

[52] U.S. Cl. ..... 227/2; 227/131; 227/155

[58] Field of Search ..... 227/2, 4, 120, 227/131, 155

[56] References Cited

U.S. PATENT DOCUMENTS 5,230,457 7/1993 Hiroi et al. ..... 227/2
5,460,313 10/1995 Magnusson et al. ..... 227/131
5,460,314 10/1995 Udagawa ..... 227/131
5,702,047 12/1997 Yoshie ..... 227/2

*Primary Examiner*—Scott A. Smith
*Attorney, Agent, or Firm*—Flynn, Thiel, Boutell & Tanis, P.C.

[57] ABSTRACT

An electric stapler to bind a set of sheets with staples, is provided with a cartridge to hold the staples, a magazine to guide the cartridge in the direction of the front surface of the set of sheets, a drive motor to contact with and separate from the magazine in relation to the set of sheets, a reduction means to reduce and control angular velocity of the drive motor, and a driver plate to drive down the staples into the set of sheets through the driving force of the drive motor, performs a series of binding processes in a short time with reducing impact caused by the magazine.

8 Claims, 4 Drawing Sheets

ELECTRIC STAPLER

BACKGROUND OF THE INVENTION

1. Field of the Invention

This invention relates to an electric stapler attached to a copier machine and the like.

2. Description of the Related Art

An electric stapler relating to the present invention is equipped with a table on which a set of copied sheets are placed, and a cartridge which holds sheet staples and is also provided with a magazine vertically movable to the table, a drive mechanism to move up and down the magazine and a driver plate to drive down a staple into the set of sheets from a staple supply portion.

The drive mechanism is provided with a drive motor, a series of speed reduction gears rotated by the drive motor, and a cam turned by the speed reduction gears. One turn of the cam makes one vertical reciprocating movement of the magazine, and the driver plate tied to the reciprocating movement of the magazine shoots staples from a staple supply portion. And a series of binding processes is completed with clinching flat legs of the staple which have pierced the set of sheets with a clincher mechanism provided on the table.

In this sort of an electric stapler, in order to drive down the staple into a set of sheets with reliability, the staples are driven down after the magazine descends from its home position and holds the set of sheets between the magazine and the table.

Incidentally, this type of conventional drive motor is driven for a designated period of time to make the cam one turn as shown with an alternate long and short dash line in FIG. 4. The angular velocity of the drive shaft of the drive motor increases with the passage of time until a certain lapse of time and the angular velocity W1 is accelerated to a high velocity when the magazine descends to the position where it holds the set of sheets with the table between.

Therefore when the magazine makes forcible contact with the set of sheets S, a strong force is applied on the table through the set of sheets S, which brings such a state as if the magazine crashed against the table. It has a disadvantage that the magazine has a heavy weight due to the installed cartridge which holds the sheet staples, giving a big impact on the table with a loud noise. And there is a possibility that the sheet staples may be separated at connecting portions. Particularly, in an electric stapler in which the table and the magazine are separated, these disadvantages are remarkable because the reciprocating motion of the magazine is set in high speed so that a series of binding processes can be completed in a short time.

In considering the above described disadvantages, it is an object of the present invention to present an electric stapler which can complete a series of binding processes in a short time with a reduced impact from the magazine.

SUMMARY OF THE INVENTION

An electric stapler which binds sets of sheets with staples, relating to the present invention to achieve the above described purposes, features to be provided with a cartridge to hold the staples, a magazine to guide the cartridge in the direction of a front surface of a set of sheets, a drive motor to contact and separate the magazine with and from the set of sheets, a reduction means to reduce and control the angular velocity of the drive motor, and a driver plate which drives down the staples into the set of sheets with a driving force from the drive motor.

Any speed reduction means that electrically or mechanically reduces the angular velocity of the drive motor can be available. More specifically, the reduction can be performed through (1) suspension of supply current to the drive motor for a designated period of time, (2) PWM control, or (3) a combination of the suspension of supply current to the drive motor for a designated period of time and PWM control.

BRIEF DESCRIPTION OF THE DRAWINGS

FIG. 2 (B) is a side elevational view showing the relation between the circular plate and the sensor;

FIG. 5 (B) is a graphical representation showing that the ON/OFF control by PWM of the drive motor is carried out for the control relating to the present invention expressed with a solid line in FIG. 4; and FIG. 5 (C) is a graphical representation showing that the ON/OFF control by a combination of the suspension of electric supply to the drive motor for a designated period of time and PWM control of the drive motor is carried out for the control relating to the present invention expressed with a solid line in FIG. 4.

DETAILED DESCRIPTION OF THE PREFERRED EMBODIMENT(S)

An embodiment relating to the present invention is explained based on the drawings here.

Figure 1:
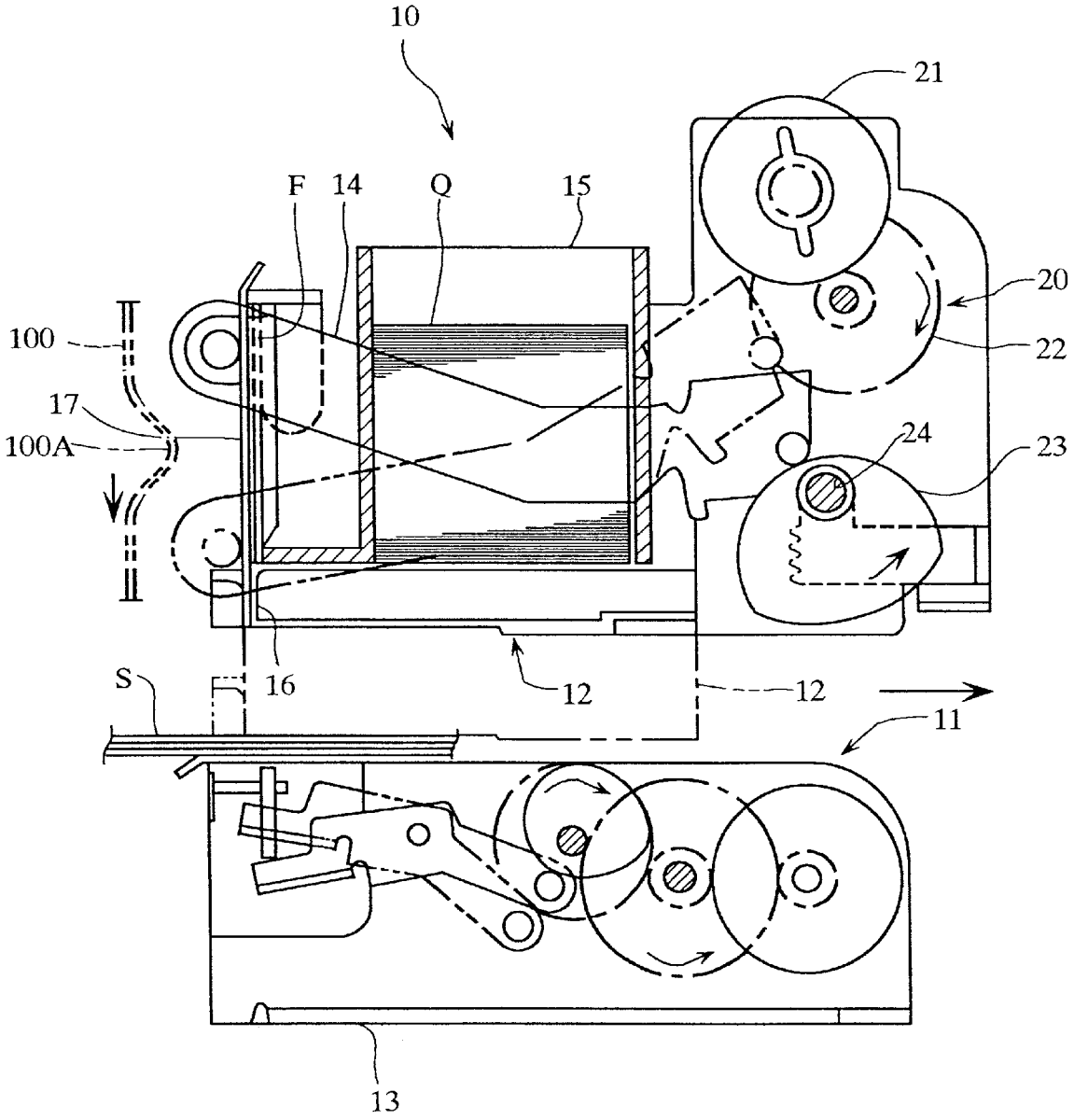
FIG. 1 is a diagrammatic sectional view showing a configuration of an electric stapler relating to the present invention.

FIG. 1 shows an electric stapler 10 installed in a copier machine and the like. The electric stapler 10 has a table 11 on which a set of sheets S ejected from the copier machine is placed, a magazine 12 opposedly placed above the table 11 in a vertically movable manner, and a drive mechanism 20 to move the magazine 12 vertically.

The table 11 is provided with a clincher mechanism 13 to clinch the flat legs of a staple when pierced a set of sheets S.

The magazine 12 moves up and down in accordance with a vertical movement of the drive link 14 between positions expressed by a solid line and a chain line, and detachably installs a cartridge 15 which holds stacked sheet staples Q. The magazine 12 is provided with a staple supply portion 16 to shoot staples, a forming plate F to bend staples in a C-shape and a driver plate 17 to drive down the C-shaped staples from the staple supply portion 16.

The forming plate F and the driver plate 17 are moved up and down by the drive link 14 and after the magazine 12 is descended to a position shown with a chain line driven by the drive link 14 and holds a set of sheets S with the table 11 between, the driver plate 17 shoots the staple from the staple supply portion 16 through further movement of the drive link 14 in the direction of the arrow.

Figure 2A:
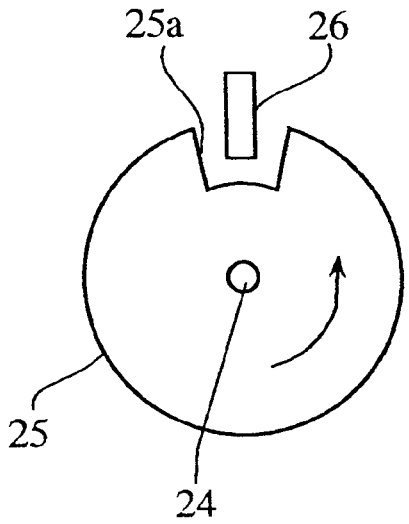
FIG. 2 (A) is a plane view showing a relation between a circular plate and a sensor.
Figure 2B:
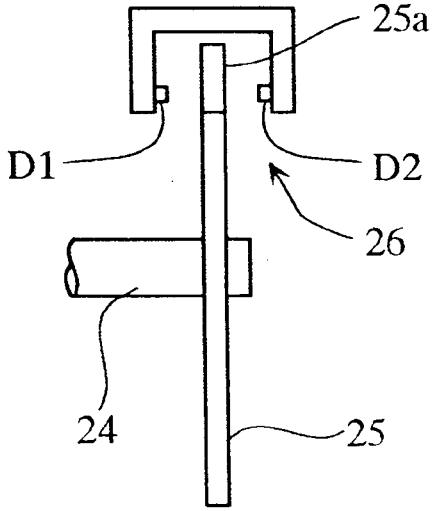

The drive mechanism 20 is provided with a drive motor 21, a series of reduction gears 22 turned by the drive motor 21, and a cam 23 turned by the series of the reduction gears 22 and moves the drive link 14 up and down. A drive shaft 24 of the cam 23 is fitted with a circular plate 25 shown in FIG. 2 and the circular plate 25 integrally rotates with the cam 23.

A cut-out 25*a* having a designated width is formed on the circular plate 25 and a sensor 26 is placed to detect the cut-out 25*a*. The sensor 26 is consisted of a light emitting diode D1 and a photoreceptive diode D2 which are positioned to put the circular plate 25 between them. When the cut-out 25*a* comes to match with the position of the sensor 26, the photoreceptive diode D2 receives the emitted light from the light emitting diode D1 and detects the cut-out 25A through the emitted light.

The position and width of the cut-out 25*a* responds to the period that the magazine 12 is positioned in a home position (a solid line in FIG. 1). That is, the sensor 26 is designed to detect the cut-out 25*a* when the magazine 12 is in the home position.

Figure 3:
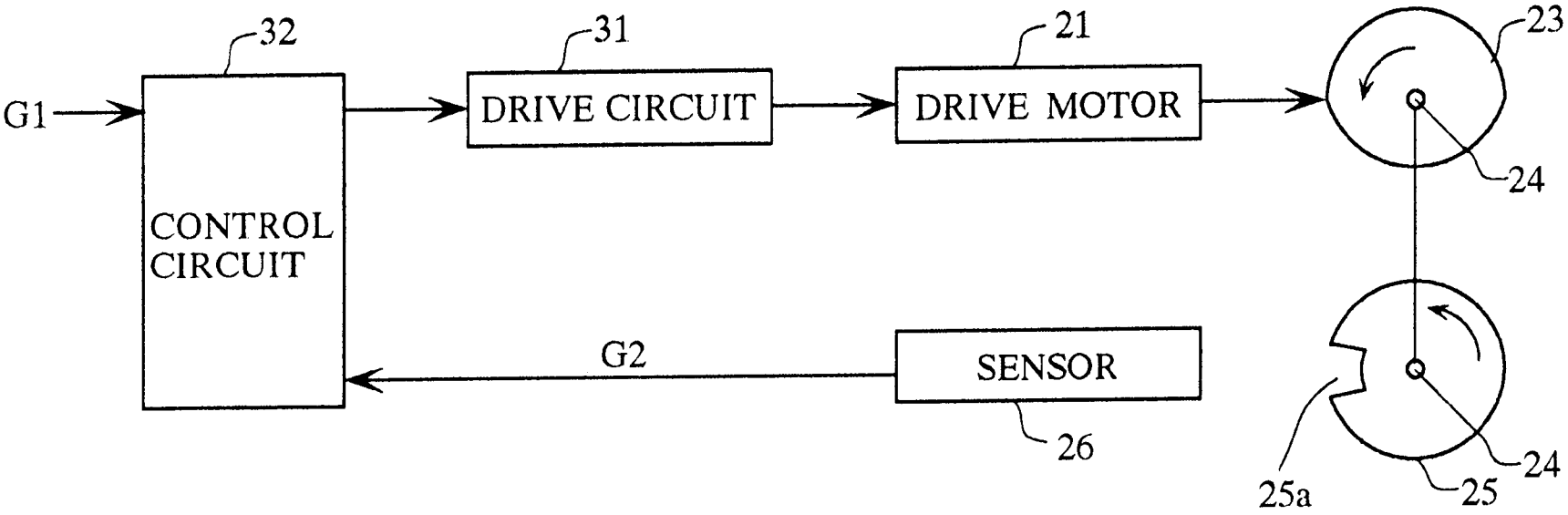
FIG. 3 is a block diagram of a configuration of a control system in the electric stapler.

FIG. 3 is a block diagram showing a control system to control the drive motor 21. In FIG. 3, the designation 31 is a drive circuit to supply current to the drive motor 21, and 32 is a control circuit consisting of, for instance, CPU and the like. The control circuit 32 controls the drive circuit 31 based on a filing signal G1 outputted from a copier machine (not shown) and a detection signal G2 which is detected by the sensor 26. The control circuit 32 has a function as a speed reduction means to temporarily reduce the speed of the drive motor by suspending current supply to the drive motor 21 for 20 microseconds from the point of time when the sensor 26 stops outputting the detection signal G2 while the drive motor 21 is operating.

A behavior of the electric stapler of the embodiment will be explained next.

The magazine 12 is waiting in the home position, when the control circuit 32 does not receive input of the filing signal G1, as shown in FIG. 1. In this state, the sensor 26 detects the cut-out 25*a* on the circular plate 25, outputting the detection signal G2 which is inputted in the control circuit 32.

And when the filing signal G1 is received by the control circuit 32, the control circuit 32 controls the drive circuit 31 to supply current to the drive motor 21.

The drive motor 21 is started to drive with the current supply and the cam 23 starts rotation through the series of reduction gears 22. When the cam 23 turns more than a designated angle, the magazine 12 starts to descend from the home position. While the magazine 12 is descending, the sensor 26 stops detecting the cut-out 25*a* of the circular plate 25, accompanied by suspension of the output of the detection signal G2 from the sensor 26.

Figure 4:
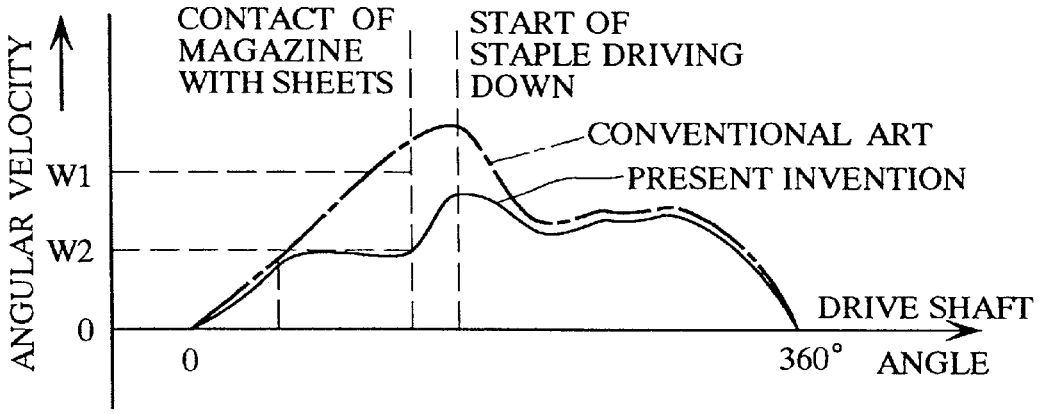
FIG. 4 is a graphical representation showing a relation between angular velocity of a drive motor and the driving period of time.
Figure 5A:
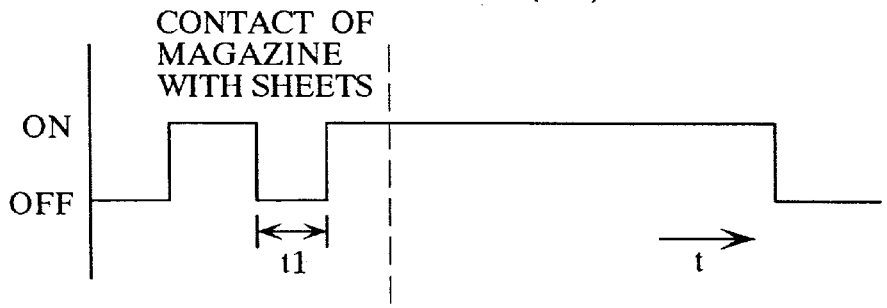
FIG. 5 (A) is a graphical representation showing that the ON/OFF control by the suspension of electric supply to the drive motor for a designated period of time is carried out for the control relating to the present invention expressed with a solid line in FIG. 4.
Figure 5B:
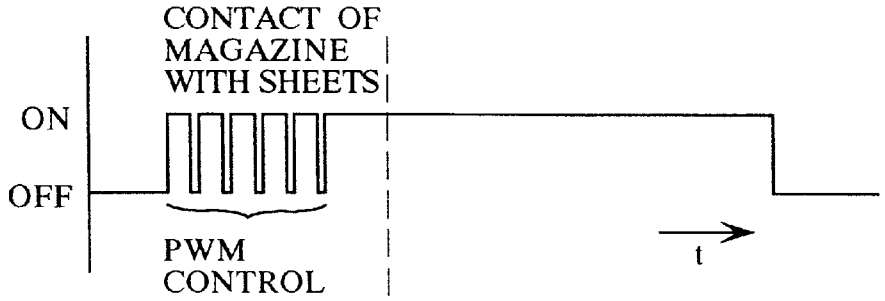
Figure 5C:
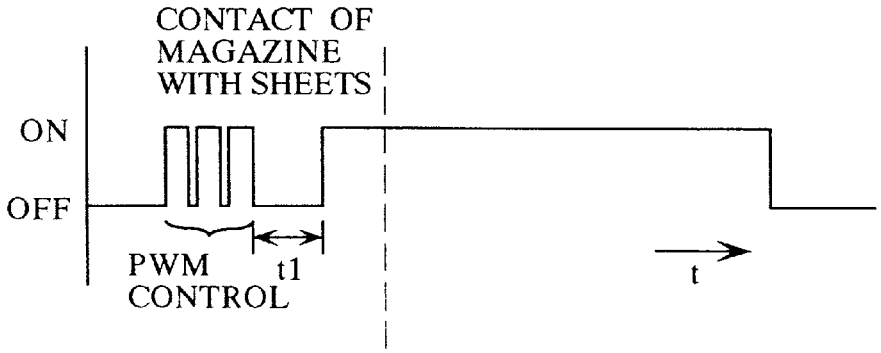

When the sensor 26 stops outputting the detection signal G2, the control circuit 32 temporarily suspends current supply to the drive motor 21 to make the drive motor 21 in an OFF state for the time being as shown in FIG. 4 and FIG. 5 (A) to FIG. 5 (C). Time t1 for keeping in the OFF state differs according to a filing speed (the speed from the time when the magazine starts moving to the time when driving down the staples into a set of sheets finishes), which is particular to the type of electric stapler used. In the electric stapler used in the present embodiment, the time for the OFF state (t1) is between 10 to 25 microseconds but preferably about 20 microseconds. When the time (t1) is shorter than 10 microseconds, the impact caused by the magazine when arriving at the sheet to be stapled (a state that the magazine forcibly contacts with a set of sheets) is high and the sound from the impact is also loud. On the contrary, when the time(t1) exceeds 25 microseconds, so called a rock state that a staple sticks into a set of sheets without completing the binding process occurs. In the present embodiment, an electric stapler having a capability of binding a set of 2 to 100 sheets of paper with a staple in a binding speed of maximum 225 msec is used.

The rotation of the drive motor 21 is braked by the OFF of the drive motor 21. Then the angular velocity of the drive motor 21 decreases, which causes reduction in speed of the cam 23 with decrease of the turning force. The downward speed of the magazine 12 is decreased due to the reduction in speed of the cam 23 and the magazine 12 is to go down while decreasing in speed.

Therefore, the angular velocity W2 of the drive motor 21 is small when the descending magazine 12 forcibly contacts with a set of sheets S.

Consequently, the impact caused by the collision of the magazine 12 with the table 11 through the set of sheets S is eased, and generation of a loud noise is prevented. And there is no possibility of damaging parts such as a broken staple, because the impact is small.

After the magazine 12 hold the set of sheets S with the table 11 between them, that is, after a lapse of 20 msec since the drive motor 21 is turned OFF, the control circuit 32 controls the drive circuit 31 and supplies an electric current to the drive motor 21. Then the drive motor 21 starts operation again, the driver plate 17 goes down through turning of the cam 23, and the staples are shot from the staple supply portion 16. The shot staple is driven down into the set of sheets S. Incidentally, T1 in FIG. 4 shows the time when the staple starts driving down into the set of sheets S.

Leg portions of the staple driven down into the set of sheets S are clinched by a clincher mechanism 13. Then, the magazine 12 goes up to return to the home position.

When the magazine 12 returns to the home position, the sensor 26 detects the cut-out 25*a* of the circular plate 25, and outputs a detection signal G2. The control circuit 32 finds through the detection signal G2 that the magazine 12 has returned to the home position, and suspends current supply to the drive motor 21 to stop driving.

Thus, as the movement of the drive motor 21 is only temporary suspended, a series of binding processes can be done in a short time as in the conventional way.

In the embodiment above described, the control of movement of the drive motor 21 is carried out by a temporary suspension (t1) of supply current to the drive motor 21 as shown in FIG. 5 (A), but the drive motor 21 can be controlled by PWM (pulse-width modulation) so that the speed in the period from the start of descending of the magazine 12 to the time of contacting the magazine 12 with the set of sheet S is kept low, as shown in FIG. 5 (B). The movement of the drive motor can be also controlled by a combination of the PWM control and the temporary suspension of supply power, as shown in FIG. 5 (C). Incidentally, in the PWM control in FIG. 5 (C), ON/OFF operation is repeatedly carried out at fixed intervals. And in the OFF state where there is no current supply to the drive motor in FIG. 5 (A) to FIG. 5 (C), a brake is to be applied to the drive motor. But the motor can be in a free run condition. Or a mechanical brake can be used to control the motor during the period. In such a case, for instance, a plate spring 100 as shown with an alternate long and short dash line in FIG. 1 is prepared, and the magazine 12 is engaged with a protrusion 100A of the plate spring 100 while descending so that the descending movement of the magazine 12 can be braked.

Further, in the embodiment above described, the drive motor 21 is placed in the OFF state for 20 micro seconds after the sensor 26 stops detecting the cut-out 25*a* of the circular plate 25, but the drive motor 21 can be in the OFF state by detecting the position of the magazine 12.

As described above, the present invention makes it possible to reduce the impact caused by the collision of the magazine with the table through a set of sheets and to prevent the generation of a loud noise. Thus, the small impact does not cause separation of sheet staples at the connecting portion. And as the operation of the drive motor is only temporary reduced in speed while the magazine is descending, a series of binding processes can be completed in a short time.

What is claimed is:

1. An electric stapler for binding a set of sheets with staples, comprising:

a cartridge to hold said staples;

a magazine to guide said cartridge in the direction of a front surface of the set of sheets;

a driving motor to contact with and separate from said magazine in relation to the set of sheets;

a reduction means for reducing and controlling angular velocity of said drive motor; and a driver plate to drive down said staple into the set of sheets through a driving force of said drive motor.

2. The electric stapler according to claim 1, wherein said reduction means suspends supply current to said drive motor for a designated period of time.

3. The electric stapler according to claim 2, wherein the period of time for the suspension of supply current to said drive motor is from the time when said magazine starts moving toward the front surface of the set of sheets till the time when said magazine forcibly contacts with the set of sheets.

4. The electric stapler according to claim 1, wherein said reduction means is performed by PWM control.

5. The electric stapler according to claim 4, wherein said PWM control repeats ON/OFF at established time intervals.

6. The electric stapler according to claim 1, wherein said reduction means is performed by a combination of PWM control and suspension of supply current to said drive motor for a designated period of time.

7. The electric stapler according to claim 1, wherein said reduction means is defined by a plate spring engaged with said magazine.

8. The electric stapler according to claim 1, further comprising a table for placing said set of sheets.

* * * * *